United States Patent [19]

Ballin

[11] 4,057,867

[45] Nov. 15, 1977

[54] POCKET HAIR BRUSH

[75] Inventor: Gene Ballin, Locust Valley, N.Y.

[73] Assignee: Product Resources International, Inc., New York, N.Y.

[21] Appl. No.: 688,806

[22] Filed: May 21, 1976

[51] Int. Cl.[2] ..... A46B 7/02

[52] U.S. Cl. ..... 15/185; 15/143 R; 15/203; 132/11 R

[58] Field of Search ..... 15/184, 185, 201, 202, 15/203, 187, 188, 143 R; 132/11 R, 85; 229/2.5

[56] References Cited

U.S. PATENT DOCUMENTS

| | | | |
|---|---|---|---|
| 1,307,530 | 6/1919 | Wolf | 15/203 |
| 1,713,756 | 5/1929 | Hassler | 15/188 X |
| 1,731,288 | 10/1929 | Beissbarth | 15/187 |
| 2,604,649 | 7/1952 | Stephensen et al. | 15/203 X |
| 2,958,889 | 11/1960 | Greenblatt | 15/187 |

FOREIGN PATENT DOCUMENTS

| | | | |
|---|---|---|---|
| 524,297 | 12/1953 | Belgium | 15/184 |

*Primary Examiner*—Peter Feldman
*Attorney, Agent, or Firm*—Howard C. Miskin

[57] ABSTRACT

A pocket hair brush having a self-contained cover in an integral unit formed of a thermoplastic polymeric resin and includes a backing plate flexible rectangular panel having integrally formed bristles projecting from a face thereof. Rectangular side panels are joined to the backing plate by self-hinges and rectangular wing panels are joined to the side panel outer side edges and form dihedral angles therewith. A short notch is medially formed along the junction between one of the side and wing panels and extensions with enlarged ends are medially formed at opposite sides of the other wing panel. The side and wing panels are swingable between a closed position covering the bristles and releasably locked by coupling of one extension and the slot and an open rearwardly directed handle defining position with the other extension engaging the slot.

9 Claims, 1 Drawing Figure

POCKET HAIR BRUSH

BACKGROUND OF THE INVENTION

The present invention relates generally to improvements in brushes and it relates more particularly to an improved hair brush having a self-contained cover.

It is a common practice to carry a small hair brush on the person, either in a clothing pocket, a pocket book or in luggage of various types. However, the use of the brush for its intended application generally results in the deposit on the brush, of hair, various scalp debris, oils and other hair and scalp emitting and applied compositions. accordingly, the return of the used brush to the pocket book or other storage receptacle is highly unsanitary and may soil and damage the surrounding articles which may be exposed thereto. Also, in turn, the brush will pick up dirt, dust, lint and debris that is in the pocketbook or other storage receptacle. To this end, to facilitate the sanitary storing and carrying of the hair brush, covers, either separate from or forming part of the brush assembly, are provided so that the brush bristles may be at least partially enclosed to prevent their exposure to the surroundings and the release thereto of the foreign material carried by the brush. The type of brush bristle enclosures heretofore available and proposed, however, possess numerous drawbacks and disadvantages. They are generally complex, bulky and expensive devices, awkward and inconvenient to us, of little adaptability and versatility and otherwise leave much to be desired.

SUMMARY OF THE INVENTION

It is a principal object of the present invention to provide an improved brush device.

Another object of the present invention is to provide an improved hair brush device which is transferrable between a bristle exposed operative condition and a bristle protected closed condition for storage and carrying purposes.

Still another object of the present invention is to provide an improved hair brush having a self-contained cover which may be easily and conveniently applied and opened.

A further object of the present invention is to provide a brush device of the above nature characterized by its reliability, simplicity, ruggedness, attractive appearance, compactness, ease and convenience of use, ease and economy of manufacture, and great versatility and adaptability.

The above and other objects of the present invention will become apparent from a reading of the following description taken in conjunction with the accompanying drawing which illustrates preferred embodiments thereof.

In a sense, the present invention contemplates the provision of a brush and cover device of the above type integrally formed of a polymeric resin and comprising a flexible intermediate rectangular panel having bristles integrally formed with projecting upwardly from the top face thereof, a pair of rectangular side panels integral with and extending along the lengths of the sides of the intermediate panel and joined thereto by self hinges of reduced thickness and swingable between a closed position extending upwardly along the sides of the bristles and a downwardly converging open position, and locking means integrally formed with the side panels for releasably locking the side panels in their respective open and closed positions.

In the preferred form of the improved brush device there are provided rectangular wing panels along the outer side edges of and integral with the side panels, forming obtuse dihedral angles therewith. A short medial coupling slot is formed at the junction of one pair of side and wing panels and the other wing panel has medially located along opposite side edges thereof long and short coupling flaps terminating in enlarged cylindrical heads for alternatively engaging the slot for releasably locking the panels in their open or closed positions. In the brush cover position the bristles converge and the wing panels overlap over the bristles and in the brush open position the bristles diverge.

The improved brush device is simple, compact, reliable and inexpensive, is easy and convenient to use, easy and economical to make, and is of great versatility and adaptability.

DESCRIPTION OF THE PREFERRED EMBODIMENTS

Figure 1:
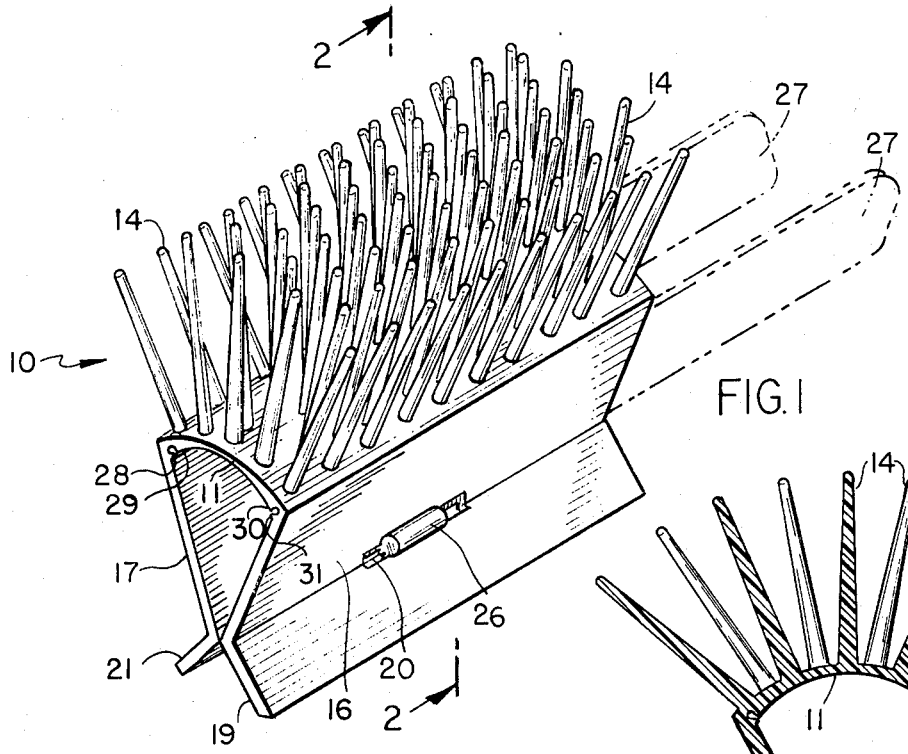
FIG. 1 is a front perspective view of a brush embodying the present invention shown in open operative position.

Referring now to the drawing which illustrates preferred embodiments of the present invention, the reference numeral 10 generally designates the improved brush device which is an integrally formed unit. The brush device 10 is formed of a flexible, resilient thermoplastic resin such as a polyolefin, for example polyethylene or polypropylene, or the like, and is advantageously produced by injection molding.

Figure 3:
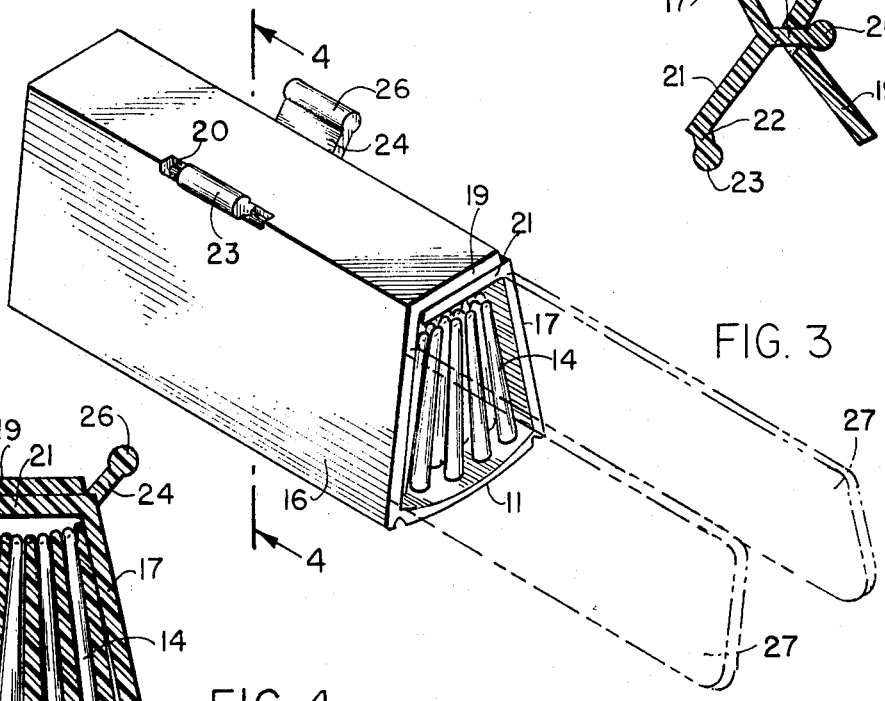
FIG. 3 is a view similar to FIG. 1 with the brush shown in covered position.
Figure 4:
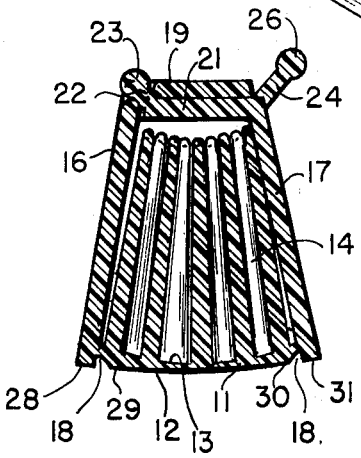
FIG. 4 is a sectional view taken along line 4—4 in FIG. 3.

The brush device 10 includes a rectangular bristle backing defining intermediate panel 11 molded with a longitudinally cylindrically concave underface 12 and a flat top face 13 so that the side borders of intermediate panel 11 are thicker than the medial portion thereof to facilitate the flexing of intermediate panel 11 about its medial longitudinal axis. Integrally formed with intermediate panel 11 and projecting upwardly from its top face 13 are regularly suitably spaced upwardly tapered bristles 14 which converge upwardly and inwardly when the panel top face 13 is concave as shown in FIGS. 3 and 4, so that the bristle assembly is in a compact state.

Disposed along the longitudinal side edges of intermediate panel 11 and extending for the full lengths thereof are opposite rectangular, substantially rigid side panels 16 and 17 respectively, both side panels 16 and 17 being slightly wider than the length of bristles 14 and the side panel 16 being somewhat wider than the side panel 17. Each of the side panels 16 and 17 is joined along a line slightly above its bottom inside face, when in closed position as shown in FIGS. 3 and 4, to the respective upper longitudinal side edge of intermediate panel 11 by a longitudinally extending self hinge 18 of reduced thickness and integrally formed with the intermediate panel 11 and the respective side panel to permit the swinging of the side panels 16 and 17 about their inner longitudinal axis between upwardly and downwardly converging positions. Disposed along self hinges 18 between intermediate panel 11 and corresponding side panels 16 and 17 are grooves defined by opposing shoulders 28 and 29 and 30 and 31 respectively, as seen best in FIG. 4. In open position shoulders 28 and 29 and 30 and 31 abut before the opposite longitudinal edges of side panels 16 and 17 abut thereby forcing or bending panel 11 into a convex shape as seen best in FIG. 2.

A first rectangular wing panel 19 is integrally formed with and extends for the full length of the outer edge of side panel 16 and is of a width slightly greater than that of the top of the convergent group of bristles 14. The side and wing panels 16 and 19 form an inside obtuse dihedral angle somewhat greater than 90 degrees. Formed along the junction of side and wing panels 16 and 19 intermediate the ends thereof is a short medial longitudinal coupling slot 20.

A second rectangular wing panel 21 is integrally formed with and extends for the full length of the outer edge of side panel 17 and is of approximately the width of wing panel 19. Like the side and wing panels 16 and 19 the side and wing panels 17 and 21 form an inside obtuse dihedral angle somewhat greater than 90 degrees. Medially projecting from the outer edge of wing panel 21 is an angularly directed short flat projection 22 of less thickness and length than slot 20 and terminating in an enlarged longitudinal cylindrical coupling head 23 of a diameter slightly greater than the width of slot 20. Medially outwardly projecting from the junction of side and wing panels 17 and 21 is an angularly outwardly projecting relatively long flat projection 24 of less thickness and length than slot 20 and terminating in an enlarged longitudinal cylindrical coupling head 26 of a diameter slightly greater than the width of slot 20.

Figure 2:
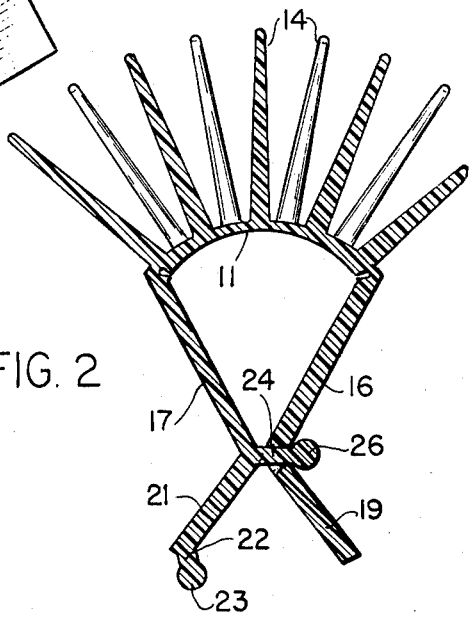
FIG. 2 is a sectional view taken along line 2—2 in FIG. 1.

Considering now the operation of the improved brush device 10 described above, in the open operative position of the brush device 10 the side panels converge downwardly from the intermediate panel, as seen in FIGS. 1 and 2, to bring the outer edges of side panels 16 and 17 into engagement with the wing panels 19 and 21 diverging downwardly. The brush device 10 is releasably locked in its open position by the coupling projection 24 extending through slot 20 and being retained in engagement therewith by coupling head 26. In the brush open position the intermediate panel 11 is flexed to be upwardly convex to spread the bristles 14. In open position, wing panels 19 and 21 provide easy and comfortable holding for manipulating of the brush in use, either between the thumb resting on one wing panel and the remaining fingers on the other wing panel or having the index and middle fingers lie along the angle formed between side panel 16 and wing panel 19 and side panel 17 and wing panel 21.

The brush device 10 is covered or closed for storage purposes by separating coupling projection 24 from slot 20 and the side panels 16 and 17 are then folded upwardly, as seen in FIGS. 3 and 4, to bring the wing panels in superimposed condition with wing panel 19 overlying wing panel 21 and the coupling projection 22 is inserted through coupling slot 20 and releasably maintained therein by coupling head 23. In the closed condition of the brush device 10, the bristles 14 converge inwardly and the compact bristle bundle is releasably housed in the space delineated by panels 11, 16, 17 and 21. To open the closed brush device the closing procedure described above is reversed.

Although the side panels 16 and 17 and wing panels 19 and 21 of the opened brush device function as a handle, the side panels may be provided with integrally formed elongated longitudinal projections 27 shown by broken line, which may be of any desired configuration and serve as a handle. These handles could be made foldable along their junction with side panels 16 and 17 respectively.

While the bristles 14 were shown molded integrally to panel 11, panel 11 could be molded with openings for the bristles, which bristles or bristle clusters could be inserted. Since panel 11 is thinner along the center poriton, panel 11 goes from convex to concave position when the brush is in its open or closed condition respectively.

While there have been described and illustrated preferred embodiments of the present invention, it is apparent that numerous alterations, omissions and additions may be made without departing from the spirit thereof.

I claim:

1. A brush and cover device integrally formed of a polymeric resin comprising a flexible intermediate rectangular panel having bristles projecting upwardly from the top face thereof, a pair of side panels integral with and extending along the sides of said intermediate panel and joined thereto by self hinges of reduced thickness and swingable between a closed position upwardly along the sides of said bristles and a downwardly converging open position, wing panels extending along the outer side edges of said side panels and forming dihedral angles therewith, said wing panels overlying said bristles when said side panels are in closed position and diverging downwardly and outwardly when said side panels are in their open position and locking means integrally formed with said side panels for releasably locking said side panels in their respective open and closed positions.

2. The brush and cover device of claim 1 wherein said side and wing panels are substantially rectangular and the outer dihedral angles between said wing and side panels are obtuse when said side panels are in their open position.

3. The brush and cover device as in claim 1 wherein said bristles are integrally formed with said intermediate panel and the side panels are rectangular and extend along the length of said intermediate panel.

4. A brush and cover device integrally formed of a polymeric resin comprising a flexible intermediate rectangular panel having bristles projecting upwardly from the top face thereof, a pair of side panels integral with and extending along the sides of said intermediate panel and joined thereto by self hinges of reduced thickness and swingable between a closed position upwardly along the sides of said bristles and a downwardly converging open position, wing panels extending along the outer side edges of said side panels and forming dihedral angles therewith, said wing panels overlying said bristles when said side panels are in closed position and diverging downwardly and outwardly when said side panels are in their open position, locking means integrally formed with said side panels for releasably locking said side panels in their respective open and closed positions, and a coupling aperture formed at the junction of one of said wing and side panels, said locking means comprising coupling elements located along opposite sides of the other wing panel and alternatively releasably engaging said aperture when said panels are respectively in their open and closed positions.

5. The brush and cover device of claim 4 wherein said aperture is a longitudinally extending slot and each of said coupling elements comprises a flap member terminating in a longitudinally extending enlarged head.

6. The brush and cover device of claim 5 wherein the flap member along the junction of the respective wing and side panels is longer than the other flap member.

7. The brush and cover device of claim 1 wherein said intermediate panel is upwardly convex with said bristles diverging when said side panels are in open position and is substantially concave with said bristles converging when said side panels are in closed position.

8. The brush and cover device of claim 7 wherein said intermediate panel has thicker edge portions than the center portion.

9. The brush and cover device of claim 1 including handle defining projections extending longitudinally from a pair of proximate ends of said side panels.

* * * * *